US006474401B1

(12) United States Patent
Streubel

(10) Patent No.: US 6,474,401 B1
(45) Date of Patent: Nov. 5, 2002

(54) CONTINUOUS CASTING MOLD

(75) Inventor: Hans Streubel, Erkrath (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/349,634

(22) Filed: Jul. 8, 1999

(30) Foreign Application Priority Data

Jul. 16, 1998 (DE) ..... 198 31 998

(51) Int. Cl.[7] ..... B22D 11/04; B22D 11/055
(52) U.S. Cl. ..... 164/418; 164/443
(58) Field of Search ..... 164/418, 459, 164/443, 485

(56) References Cited

U.S. PATENT DOCUMENTS 4,955,428 A * 9/1990 Schrewe ..... 164/418

5,176,197 A * 1/1993 Hamaguchi et al. ..... 164/418

* cited by examiner

*Primary Examiner*—Kuang Y. Lin
(74) *Attorney, Agent, or Firm*—Friedrich Kueffner

(57) ABSTRACT

A continuous casting mold for manufacturing slabs, particularly for manufacturing thin slabs includes water-cooled short side walls and long side walls, wherein a casting funnel is formed between the long side walls in an area where the long side walls extend parallel to each other and extend outwardly toward the two short side walls and cooling grooves are provided on the other outer or rearward sides of the long side walls. The rearward sides of the long side walls are each reinforced by a wall armor starting at a mold location below the lowest molten metal level, wherein the thickness of the wall armor decreases in the strand casting direction from a greatest thickness at the mold location below the lowest molten metal level.

5 Claims, 2 Drawing Sheets

CONTINUOUS CASTING MOLD

BACKGROUND OF THE INVENTION

1. Field of the Invention

The present invention relates to a continuous casting mold for manufacturing slabs, particularly for manufacturing thin slabs. The continuous casting mold includes water-cooled short side walls and long side walls, wherein the long side walls are composed of copper plates, and wherein a casting funnel is formed between the long side walls in an area where the long side walls extend parallel to each other and extend outwardly toward the two short side walls and cooling grooves are provided on the other outer or rearward sides of the long side walls.

2. Description of the Related Art

The thin slabs manufactured in continuous casting plants serve as preliminary strips for producing hot wide strip with final thicknesses of between, for example, 1–12 mm. This is carried out in a heat on conventional, so-called CSP plants or compact strip production plants in which the casting machine is combined with an equalizing furnace and a subsequent rolling train in a line (see, for example, "Stahl und Eisen" 108 (1988) No. 3, pages 99 to 109). In this process, the funnel-shaped mold together with the pouring pipe immersed in the casting funnel constitute the core element of the CSP casting process. The heat removal in the area of the molten metal level and the service life of the mold are of particular importance because the surface quality of the thin slab strand is to a significant extent influenced by the first solidification starting in the mold of the liquid steel supplied through the pouring pipe. These criteria are applicable to the same extent to the manufacture of slabs having the range of dimensions of 320 to 150×3,000 to 800 mm by means of a plate-type mold which then usually does not require a pouring funnel.

The strand shell growth is determined to a significant extent by the casting powder, the copper wall thickness between the cooling duct and the work side as well as the flow velocity in the cooling ducts. It has been found that an important reason that longitudinal cracks occur in the strand shell is a non-uniform and/or excessive heat removal over the width and height in the upper mold portion. The uneven heat removal is due to different thicknesses of the lubricating film between the strand shell and the copper wall.

For reasons of quality, copper walls having a thickness of, for example, 25 mm and 15 mm are used in molds of CSP plants; the respective dimension depends essentially on the strand dimensions and the casting speed which determine the heat removal required for the formation of the strand shell.

SUMMARY OF THE INVENTION

Therefore, it is the primary object of the present invention to provide a continuous casting mold of the above-described type which makes it possible to improve the surface quality of the thin slab to be cast and in which the occurrence of longitudinal cracks can be avoided or at least minimized.

In accordance with the present invention, the rearward sides of the long side walls are each reinforced by a wall armor starting at a mold location below the lowest molten metal level, wherein the thickness of the wall armor decreases in the strand casting direction from a greatest thickness at the mold location below the lowest molten metal level.

In continuous casting, the molten steel which is introduced into the mold and solidifies at the mold walls leads to the known temperature profile, i.e., the so-called temperature bulge in the mold plate. In contrast to the otherwise very rapid vertical temperature drop following this temperature bulge in an area up to about 100 mm below the molten metal level, the wall armor according to the present invention makes it possible to reduce this very rapid temperature drop below the temperature bulge, wherein the starting point of the armor is determined by taking into consideration the contour of the meniscus at the molten metal level which depends on the casting speed, and wherein the armor begins with its greatest thickness, following a previous increase or transition over a short distance, approximately 20 to 50 mm below the meniscus in the casting direction.

By increasing the copper wall thickness below the meniscus, the heat removal at this location is reduced and the generation of longitudinal cracks is counteracted by a smaller thermal load on the strand shell. This is because the armor or increased wall thickness which already starts in the area of the temperature bulge prevents an excessively high heat removal, wherein the heat removal is only once again steadily increased with the conically downwardly decreasing thickness of the long side wall, so that an equalization can be achieved in the sense that the temperature difference is such that there is no danger of longitudinal cracks.

In accordance with an advantageous further development of the invention, an upper end portion of the wall armor of limited length extends parallel to the mold wall. This further advantageously influences the equalization of the temperature drop. This is because this upper end portion of the wall armor with maximum thickness, which depending on the requirements may be 3 to 15 mm, and which after a short increase has about a length of 20 to 100 mm, is located at a location where the heat removal otherwise is too high, and, thus, the armor with increased thickness prevents an excessive heat removal from the cooling water side.

In accordance with a feature of the invention, the wall armor decreases from the transition from the pouring funnel to the mold end portion which follows the pouring funnel in the strand casting direction and which determines the shape of the strand. In this manner, it is achieved that the copper wall thickness in the front of water decreases over the length of the cooling grooves and, thus, the heat removal can be influenced in a targeted manner over the height of the mold.

In accordance with a further development of the invention, the thickness of the wall armor varies over the width and height of the mold in dependence on the temperature distribution in the mold. The resulting varying pattern of the groove geometry in the copper plate advantageously influences the desired temperature equalization of the height and width of the mold provided by the armor configured in accordance with the temperature decrease in dependence on the casting parameters.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
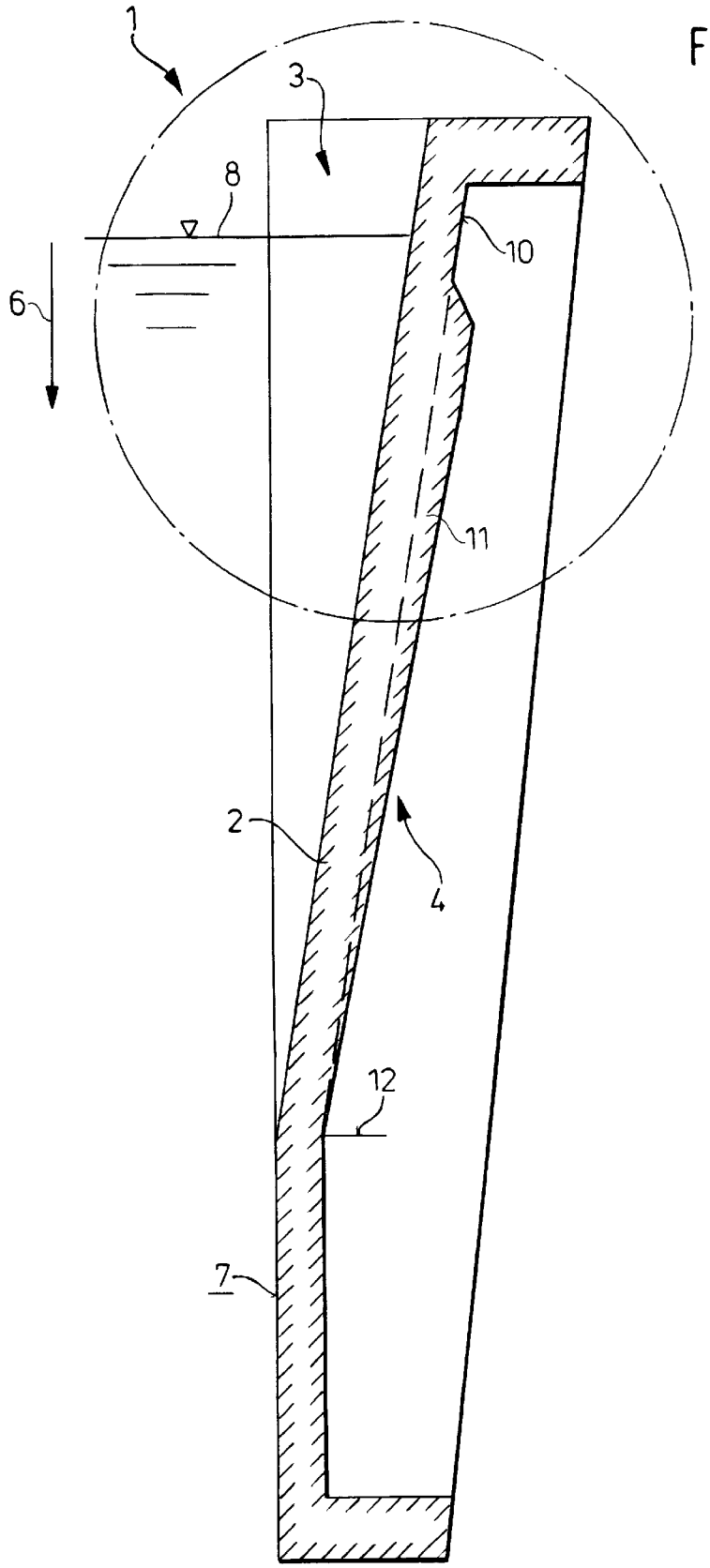
FIG. 1 is a longitudinal sectional view of a long side wall of a continuous casting mold.
Figure 3:
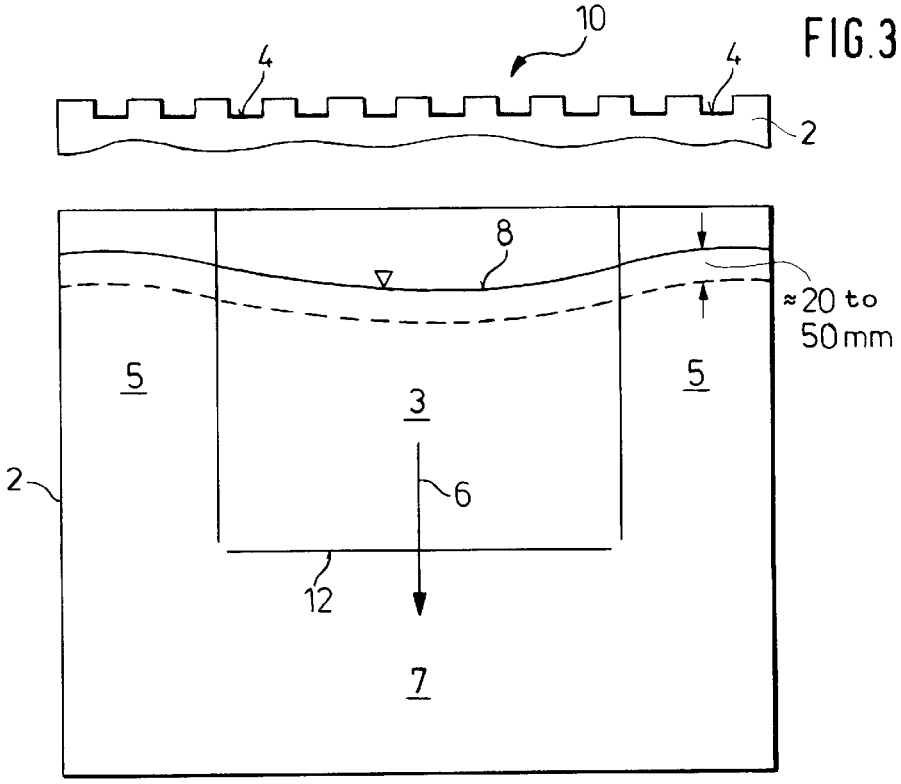
FIG. 3 is a view of the long side of the mold of FIG. 1 as seen from the left hand side, and showing above the long side wall as a detail the cooling grooves on the rear side of the long side wall.

Of an otherwise well known continuous casting mold 1 of a casting machine for manufacturing thin slabs, FIG. 1 schematically shows one of the two complementary and oppositely located long side walls 2. The long side walls are constructed for receiving a pouring pipe, not shown, and are constructed at the inner sides to form a pouring funnel 3 and are provided at their outer sides with water-conducting cooling grooves 4, as particularly shown in FIG. 3. The outer portions 5 of the two complementary long side walls 2 extending adjacent the pouring funnel 3 toward the short side walls extend parallel to each other. As seen in FIGS. 1 and 3, the pouring funnel 3 is followed in the continuous casting direction 6 by the cross-section 7 of the mold walls which determines the shape of the cast slab.

Figure 2:
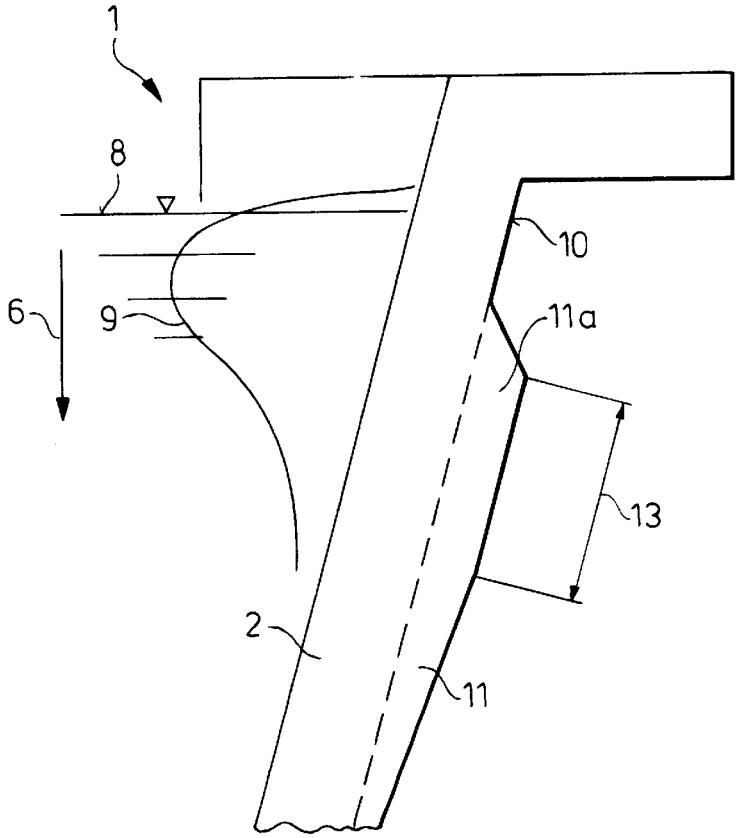
FIG. 2 shows as a detail and on a larger scale the upper portion of the mold wall of FIG. 1.

The molten steel which is poured into the continuous casting mold 1 up to the meniscus 8 cools down over the height of the mold with a very rapid temperature drop which leads to stresses in the strand shell which is increasingly formed in the strand casting direction 6, wherein the stresses lead to longitudinal cracks which can be observed in the strand shell predominantly up to about 150 mm below the meniscus 8. Depending on the casting parameters, the meniscus 8 is located at a distance of, for example, 20 to 60 mm, from the upper edge of the mold, wherein, starting from the meniscus 8, the cooling behavior of the molten steel in the mold plates is characterized by a so-called temperature bulge 9, schematically illustrated in FIG. 2, wherein this curve illustrated in FIG. 2 shows the significant temperature drop below the temperature bulge 9.

In order to prevent the significant temperature drop of the mold occurring in conventional continuous casting molds in accordance with the curve following the temperature bulge 9 and to achieve a temperature equalization, i.e., an essentially equal heat removal over the height of the continuous casting mold 1, the rearward sides 10 of the long sides wall 2 have been reinforced by a wall armor 11 as compared to the conventional contour shown in broken lines in FIG. 1, wherein the thickness of the wall armor 11 decreases in the strand casting direction 6 and the tip of the conical shape of the wall armor 11 ends approximately at the transition 12 between the pouring funnel 3 to the subsequent casting cross-section 7 which determines the shape of the strand, as shown in FIG. 3. The wall armor 11 starts approximately 20 to 50 mm below the lowest level 8 of the molten steel, and, as illustrated in FIG. 3, the beginning of the wall armor 11 is adapted over the width of the mold to the meniscus formed in the mold at the level of the molten steel. Accordingly, the upper end portion 11*a* of the wall armor 11 still protrudes into the area of the temperature bulge 9 and extends in this uppermost portion over a distance 13 of about 20 to 100 mm parallel to the mold wall before it has an inclined shape and its thickness decreases. A short portion with increasing thickness is located in front of the upper end portion 11*a*.

As a result of the wall armor 11, which not only varies over the height but also over the width of the continuous casting mold and which decreases steadily in the strand casting direction 6, the work temperature in the areas with an increased thickness wall armor is raised and, thus, especially the rapid temperature drop below the temperature bulge 9 is significantly reduced, i.e., the heat removal is equalized over the height and width of the continuous casting mold 1.

While specific embodiments of the invention have been shown and described in detail to illustrate the inventive principles, it will be understood that the invention may be embodied otherwise without departing from such principles.

I claim:

1. A continuous casting mold adapted for casting molten steel for manufacturing slabs, particularly for manufacturing thin slabs, the molten steel defining during operation of the mold a lowest molten steel level, the continuous casting mold comprising water-cooled short side walls and long side walls, wherein the long side walls have inner sides and outer sides, wherein the inner sides of the long side walls define a pouring funnel and the inner sides extend parallel to each other from the pouring funnel toward the short side walls, and wherein the outer sides of the long side walls have cooling grooves, further comprising a wall armor on the outer sides of the long side walls only for reinforcing the long side walls only, the wall armor extending from a location below the lowest molten steel level downwardly in a strand casting direction, wherein a thickness of the wall armor decreases from the location below the lowest molten-steel level downwardly in the strand casting direction.

2. The continuous casting mold according to claim 1, wherein the long side walls are comprised of copper plates.

3. The continuous casting mold according to claim 1, wherein the thickness of the wall armor decreases up to a transition from the pouring funnel to a mold end portion adjacent to and following the pouring funnel in the strand casting direction.

4. The continuous casting mold according to claim 1, wherein the wall thickness of the wall armor is configured to vary over a width and height of the mold in accordance with a temperature distribution in the mold.

5. The continuous casting mold according to claim 1, wherein the wall armor has an upper end portion of limited length, wherein an outer surface of the upper end portion extends parallel to the long side wall.

* * * * *